United States Patent [19]

Shibukawa

[11] Patent Number: 4,922,794

[45] Date of Patent: May 8, 1990

[54] ELECTRONIC MUSICAL INSTRUMENT HAVING EXTERNAL MEMORY DEVICES

[75] Inventor: Takeo Shibukawa, Hamamatsu, Japan

[73] Assignee: Yamaha Corporation, Hamamatsu, Japan

[21] Appl. No.: 151,929

[22] Filed: Feb. 3, 1988

[30] Foreign Application Priority Data

Feb. 6, 1987 [JP] Japan ..... 62-25681

[51] Int. Cl.[5] ..... G10H 7/00; G10H 3/08; G10H 3/09

[52] U.S. Cl. ..... 84/601; 84/602; 84/622; 84/641; 84/642; 84/DIG. 2; 364/900

[58] Field of Search ..... 84/1.01, DIG. 29, DIG. 2, 84/1.28, 462, 1.03, 600–602, 609, 618, 622, 641, 642, 644; 364/200, 900, 200 MS File, 900 MS File

[56] References Cited

U.S. PATENT DOCUMENTS

| | | | |
|---|---|---|---|
| 3,449,724 | 6/1969 | Boland et al. | 364/200 |
| 4,147,083 | 4/1979 | Woron et al. | 84/622 |
| 4,215,619 | 8/1980 | Budelman et al. | 84/609 |
| 4,287,568 | 9/1981 | Lester | 84/609 X |
| 4,572,048 | 2/1986 | Frauz et al. | 84/622 |
| 4,614,983 | 9/1986 | Usami | 84/DIG. 29 X |
| 4,615,024 | 9/1986 | Usui | 84/1.28 X |
| 4,624,171 | 11/1986 | Yuzawa et al. | 84/1.03 |

*Primary Examiner*—A. T. Grimley
*Assistant Examiner*—Mâtthew S. Smith
*Attorney, Agent, or Firm*—Spensley Horn Jubas & Lubitz

[57] ABSTRACT

An electronic musical instrument includes a musical tone information storing device, a plurality of external memory devices, a control unit, a switching unit, and a determining unit. The musical tone information storing device stores musical tone information. The control unit controls information transfer between at least one of the external memory devices and the musical tone information storing device. The switching unit generates a transfer command. The determining unit determines whether an external memory device of the highest priority in accordance with a predetermined priority is in a transfer enable state. The control unit controls information transfer between the external memory device of the highest priority which is selected by the determining unit and the musical tone information storing device.

8 Claims, 12 Drawing Sheets

FIG.

ELECTRONIC MUSICAL INSTRUMENT HAVING EXTERNAL MEMORY DEVICES

BACKGROUND OF THE INVENTION

The present invention relates to an electronic musical instrument which can be used together with a plurality of external memory (or recording) devices and, more particularly, to a technique for controlling transfer of musical tone information (musical tone parameter control information, pitch and tone duration information for automatic performance, and the like).

An example of a conventional electronic musical instrument which can be used together with a plurality of external memory (or recording) devices such as a RAM (Random Access Memory) pack and a magnetic tape recording device is an electronic musical instrument having on its panel surface a save switch, a save indicator, a load switch, and a load indicator for each of the external memory (or recording) devices.

According to such an electronic musical instrument, in order to save musical tone information of a memory of a musical instrument main body to, e.g., a RAM pack, a save switch corresponding to the RAM pack is turned on. In order to save the musical tone information of the memory of the musical instrument main body to a magnetic tape recording device, a save switch corresponding to the magnetic tape recording device is turned on. On the contrary, in order to load the musical tone information from a given external memory (or recording) device to the memory of the musical instrument main body, a load switch corresponding to the given external memory (or recording) device is turned on.

According to the above conventional technique, since the number of switches and indicators to be arranged on the panel surface is large, installation space is increased. In addition, a circuit arrangement relating to the switches and indicators is complicated, and a switching operation is troublesome.

SUMMARY OF THE INVENTION

It is, therefore, an object of the present invention to provide an electronic musical instrument in which a panel arrangement and a panel operation are simplified.

In order to achieve the above object, there is provided an electronic musical instrument comprising a musical tone information storing device for storing musical tone information, a plurality of external memory devices, control means for controlling information transfer between at least one of the external memory devices and the musical tone information storing device, switching means for generating a transfer command, and determining means for determining whether an external memory device of the highest priority in accordance with a predetermined priority is in a transfer enable state, wherein the control means controls information transfer between the external memory device of the highest priority which is selected by the determining means and the musical tone information storing device.

In this case, the external memory devices store or record information and may be a pack type RAM (RAM pack), a RAM formed integrally with a book (RAM book), a magnetic tape recording device, and the like.

The musical tone information is transferred from the information storing device to an external memory device, i.e., saved or is transferred from an external memory device to the information storing device, i.e., loaded.

A transfer enable state of an external memory device may be determined either by checking whether it is completely connected to the connecting portion or by checking whether its capacity is enough for storing the musical tone information stored in the information storing device when the information is to be saved.

According to an arrangement of the present invention, transfer control of a plurality of external memory devices is performed sequentially from one having the highest priority. Therefore, since any switching means can be used as long as it can generate a save command and/or load command regardless of the number of external memory devices, only a small number of switches and indicators need be arranged on the musical instrument panel surface.

DETAILED DESCRIPTION OF THE PREFERRED EMBODIMENTS

Figure 1:
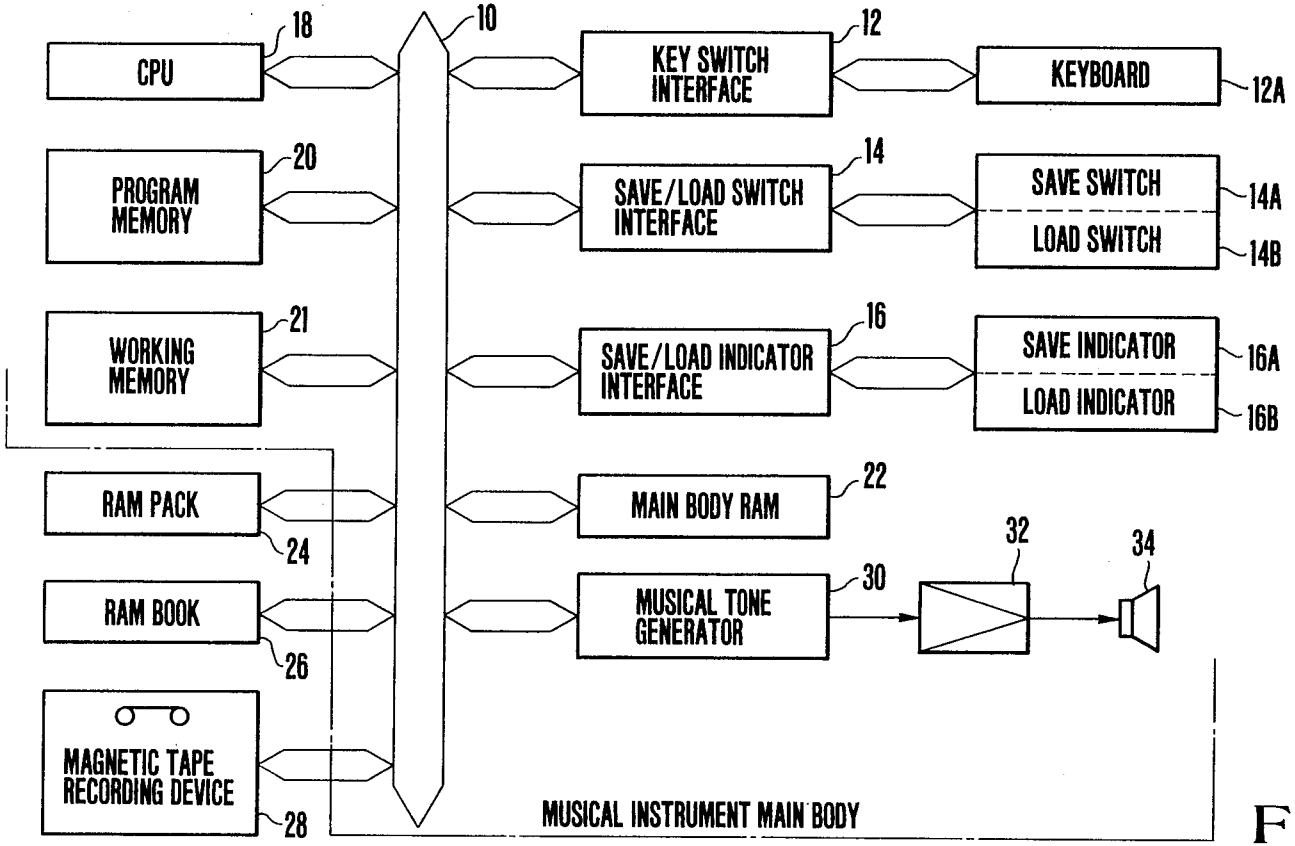
FIG. 1 is a block diagram of a circuit arrangement of an electronic musical instrument according to an embodiment of the present invention.

FIG. 1 shows a circuit arrangement of an electronic musical instrument according to an embodiment of the present invention. In the electronic musical instrument of this embodiment, generation of a variety of musical tones, musical tone information transfer between the musical instrument and the external memory (or recording) devices, and the like are controlled by a microcomputer.

Circuit Arrangement (FIG. 1)

A keyboard 12A, save and load switches 14A and 14B, and save and load indicators 16A and 16B are connected to a bus 10 through a key switch interface 12, a save/load interface 14, and a save/load indicator interface 16, respectively.

A central processing unit (CPU) 18, a program memory 20 consisting of a ROM (Read-Only Memory), a working memory 21 consisting of a RAM (Random Access Memory), a main body RAM 22 which is incorporated in a musical instrument main body, and a musical tone generator 30 are also connected to the bus 10. A RAM pack 24, a RAM book 26, and a magnetic tape recording device 28 connected as external memory (or recording) devices to corresponding connecting portions of the musical instrument main body are also connected to the bus 10.

The keyboard 12A has a large number of keys for driving key switches. Key operation information is detected for each key through the key switch interface 12.

The save and load switches 14A and 14B generate save and load commands, respectively.

The save indicator 16A normally indicates a save mode and is also used to indicate an insufficient RAM capacity of the RAM pack 24 or the RAM book 26 or to indicate occurrence of a save error as needed. The load indicator 16B indicates a load mode.

The CPU 18 executes processing for generating various musical tones, transferring musical tone information, and the like in accordance with programs stored in the program memory 20. The processing will be described later in detail with reference to FIGS. 3 to 11.

The working memory 21 includes a large number of memory areas used as registers, flags, and the like when the CPU 18 executes the above processing. The registers and the like used to practice the present invention will be described later.

The main body RAM 22 stores musical tone parameter control information such as a tone color, a volume, and an effect, and/or musical tone information such as pitch and tone duration information for automatic performance.

When the save switch 14A is turned on to set a save mode, the musical tone information can be transferred from and stored in the main body RAM to one of the external memory (or recording) devices 24 to 26. When the load switch 14B is turned on to set a load mode, the musical tone information can be transferred from and stored in one of the external memory (or recording) devices 24 to 26 to the main body RAM 22.

The musical tone generator 30 generates a musical tone signal (manual performance tone signal) based on an operation of the keyboard 12A or a musical tone signal (automatic performance signal) based on automatic performance information in the main body RAM 22. In this case, the musical tone parameter control information in the main body RAM 22 can be used to generate the above musical tone signals.

The musical tone signal from the musical tone generator 30 is supplied to a loudspeaker 34 through an output amplifier 32 and converted into a sound.

Figure 2:
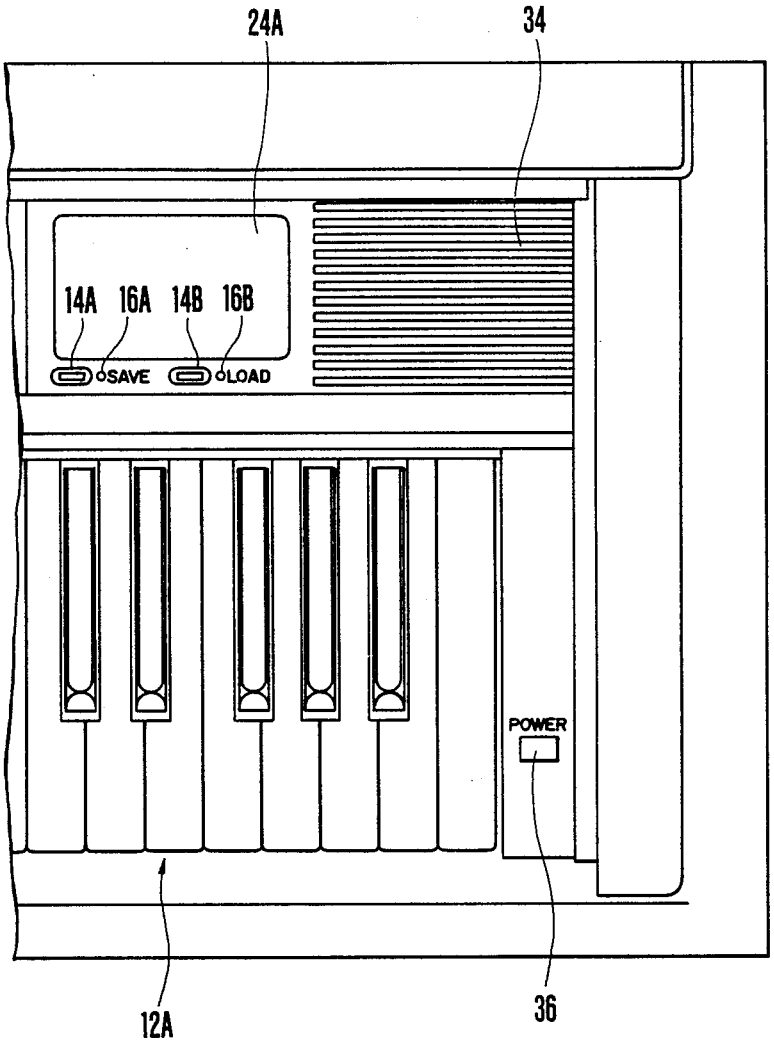
FIG. 2 is a plan view of a panel arrangement of the electronic musical instrument.

Panel Arrangement (FIG. 2)

FIG. 2 shows a panel arrangement of the above electronic musical instrument. A RAM pack inserting portion 24A in which the RAM pack 24 is inserted is provided behind the keyboard 12A, and a power switch 36 is provided to the right of the keyboard 12A. The loudspeaker 34 is provided to the right of the RAM pack inserting portion 24A.

The save and load switches 14A and 14B are provided between the keyboard 12A and the RAM pack inserting portion 24A. The save indicator 16A is provided near the save switch 14A, and the load indicator 16B is provided near the load switch 14B, respectively.

When the save switch 14A is turned on to set the save mode, the save indicator 16A is turned on. The save indicator 16A flickers when an insufficient RAM capacity o a save error is detected, and a flickering rate obtained when an insufficient RAM capacity is detected differs from that obtained when a save error is detected. When the load switch 14B is turned on to set the load mode, the load indicator 16B is turned on.

Figure 3:
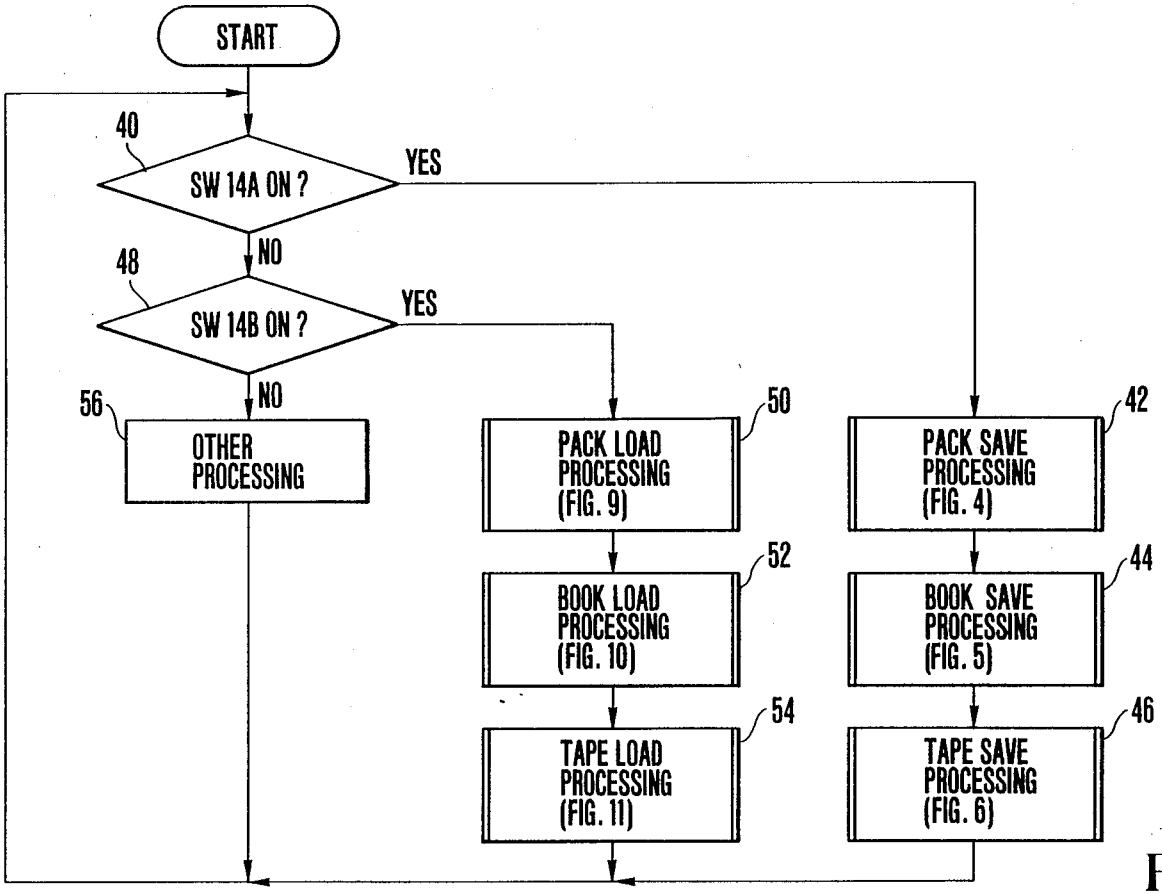
FIG. 3 is a flow chart of a main routine.

Main Routine (FIG. 3)

FIG. 3 shows a flow of processing of a main routine. This routine is started when the power switch 36 is turned on.

First, in step 40, the CPU 18 checks whether the save switch 14A is turned on. If YES (Y) in step 40, the flow advances to step 42, and a subroutine of pack save processing is executed as will be described later with reference to FIG. 4. Then, the flow advances to step 44.

In step 44, a subroutine of book save processing is executed as will be described later with reference to FIG. 5. Then, the flow advances to step 46.

In step 46, a subroutine of tape save processing is executed as will be described later with reference to FIG. 6. Thereafter, the flow returns to step 40.

If NO (N) in step 40, the flow advances to step 48, and the CPU 18 checks whether the load switch 14B is turned on. If Y in step 48, the flow advances to step 50, and a subroutine of pack load processing is executed as will be described later with reference to FIG. 9. Then, the flow advances to step 52.

In step 52, a subroutine of book load processing is executed as will be described later with reference to FIG. 10. Thereafter, the flow advances to step 54.

In step 54, a subroutine of tape load processing is executed as will be described later with reference to FIG. 11. Thereafter, the flow returns to step 40.

If N in step 48, the flow advances to step 56, and other processing is executed. The other processing includes panel information fetching processing relating to, e.g., a tone color, a volume, and an effect, manual performance tone generating processing, automatic performance tone generating processing, and the like. After step 56, the flow returns to step 40.

Figure 4:
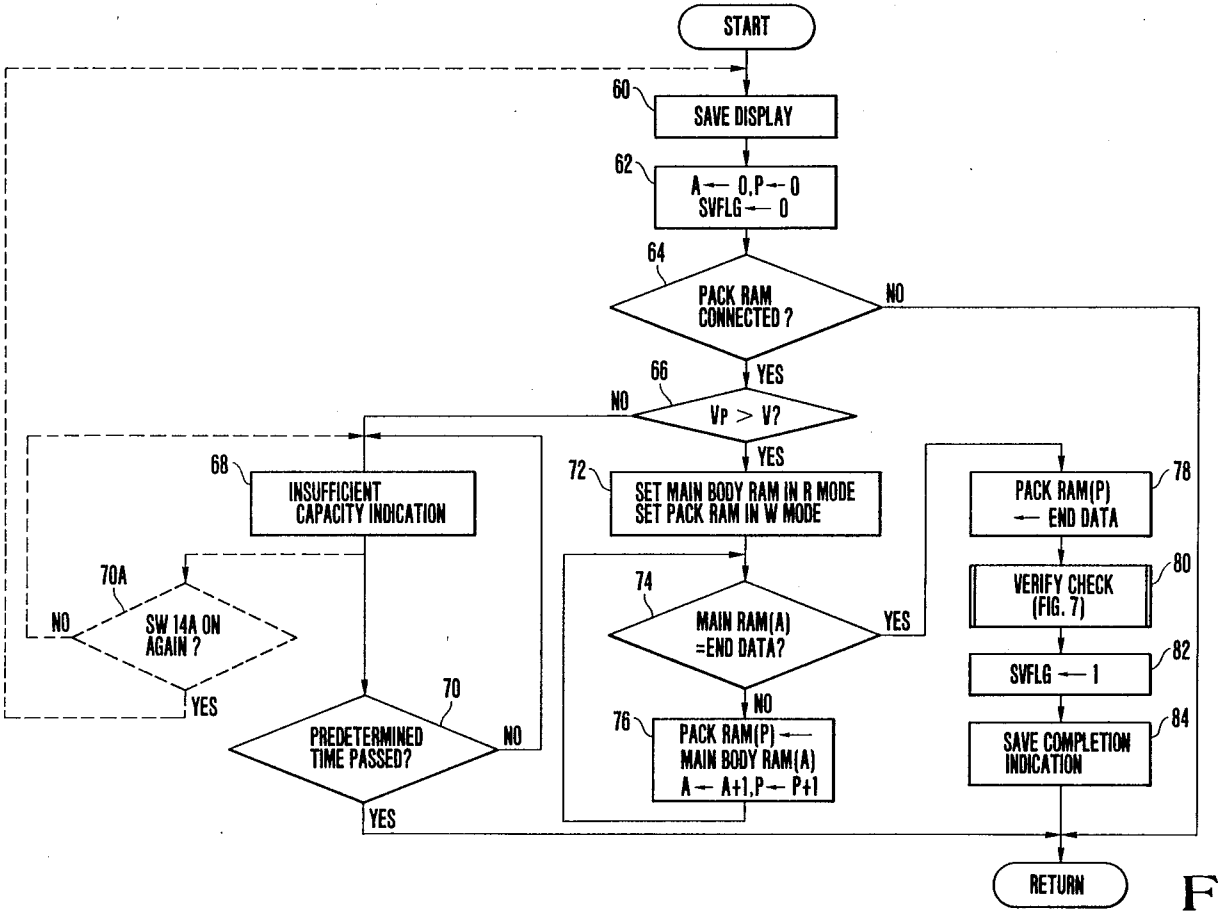
FIG. 4 is a flow chart of a subroutine of pack save processing.

Subroutine of Pack Save Processing (FIG. 4)

In the subroutine of pack save processing shown in FIG. 4, the save indicator 16A is turned on to indicate the save mode in step 60. Then, the flow advances to step 62.

In step 62, initializing processing of various registers is executed. For example, 0s are set in an address pointer A for the main body RAM, an address pointer P for an objective RAM, and a save flag SVFLG. These pointers and the flag are included in the working memory 1.

Then, in step 64, the CPU 18 checks whether a pack RAM (a RAM of the RAM pack 24) is completely connected to the musical instrument main body. This check may be executed on the basis of an output from, e.g., a connection detecting means provided to generate an output of 0 or 1 in accordance with an open or closed state of a connecting terminal. If N in step 64, the flow returns to the routine of FIG. 3. If Y in step 64, the flow advances to step 66.

In step 66, the CPU 18 checks whether a memory capacity $V_P$ is larger than a using amount (information amount) V of the main body RAM 22 (i.e., whether data can be stored in the pack RAM). If N in step 66, the flow advances to step 68.

In step 68, the save indicator 16A is flickered to indicate an insufficient capacity. In order to flicker the save indicator 16A, for example, a counter for counting clock signals may be provided. When a count of the counter reaches a predetermined value, the indicator 16A is turned on and at the same time the counter is reset. Thereafter, the counter again starts counting of the clocks. When a count reaches the predetermined value, the indicator 16A is turned off and at the same time the counter is reset. The above operation may be repeatedly executed. After step 68, the flow advances to step 70.

In step 70, the CPU 18 checks whether a predetermined time has passed from start of flickering of the indicator 16A. In this case, the predetermined time is properly determined in consideration of, e.g., a time required for replacing the RAM pack. As long as N in step 70, the flow returns to step 68, and the insufficient capacity is continuously indicated.

If Y in step 70, the flow returns to the routine of FIG. 3. That is, in this case, the RAM pack is not replaced within the predetermined time. Normally, when the insufficient capacity is indicated, the RAM pack is replaced with another having a larger capacity and the save switch 14A is turned on again. Then, the flow advances to step 66 through step 60 again.

As a modification, the CPU 18 may check in step 70A instead of step 70 as indicated by a broken line in FIG. 4 whether the save switch 14A is turned on again. In this case, as long as N in step 70A, the insufficient capacity is continuously indicated. If Y in step 70A, the flow returns to step 60.

If Y in step 66, the flow advances to step 72, and the main body RAM 22 is set in a read mode (R mode) and at the same time the pack RAM is set in a write mode (W mode). Then, the flow advances to step 74.

In step 74, the CPU 18 checks whether data at the address A of the main body RAM 22 is end data. If N in step 74, the flow advances to step 76.

In step 76, the data at the address A of the main body RAM 22 is transferred to and stored at the address P of the pack RAM. Then, values of the pointers A and P are incremented by one. Thereafter, the flow returns to step 74, and steps 74 and 76 are repeated until the pointer A points the end data.

When the pointer A points the end data, Y is obtained in step 74, and the flow advances to step 78. In step 78, the end data is transferred to and stored at the address P of the pack RAM. Then, the flow advances to step 80.

In step 80, a subroutine of verify check is executed as will be described later with reference to FIG. 7. In this routine, data written in the pack RAM are individually compared with data in the main body RAM to check whether they coincide with each other.

In step 82 after step 80, 1 is set in the flag SVFLG. Then, the flow advances to step 84, and the indicator 16A is turned off in accordance with SVFLG=1, thereby indicating completion of save. Thereafter, the flow returns to the routine of FIG. 3.

Figure 5:
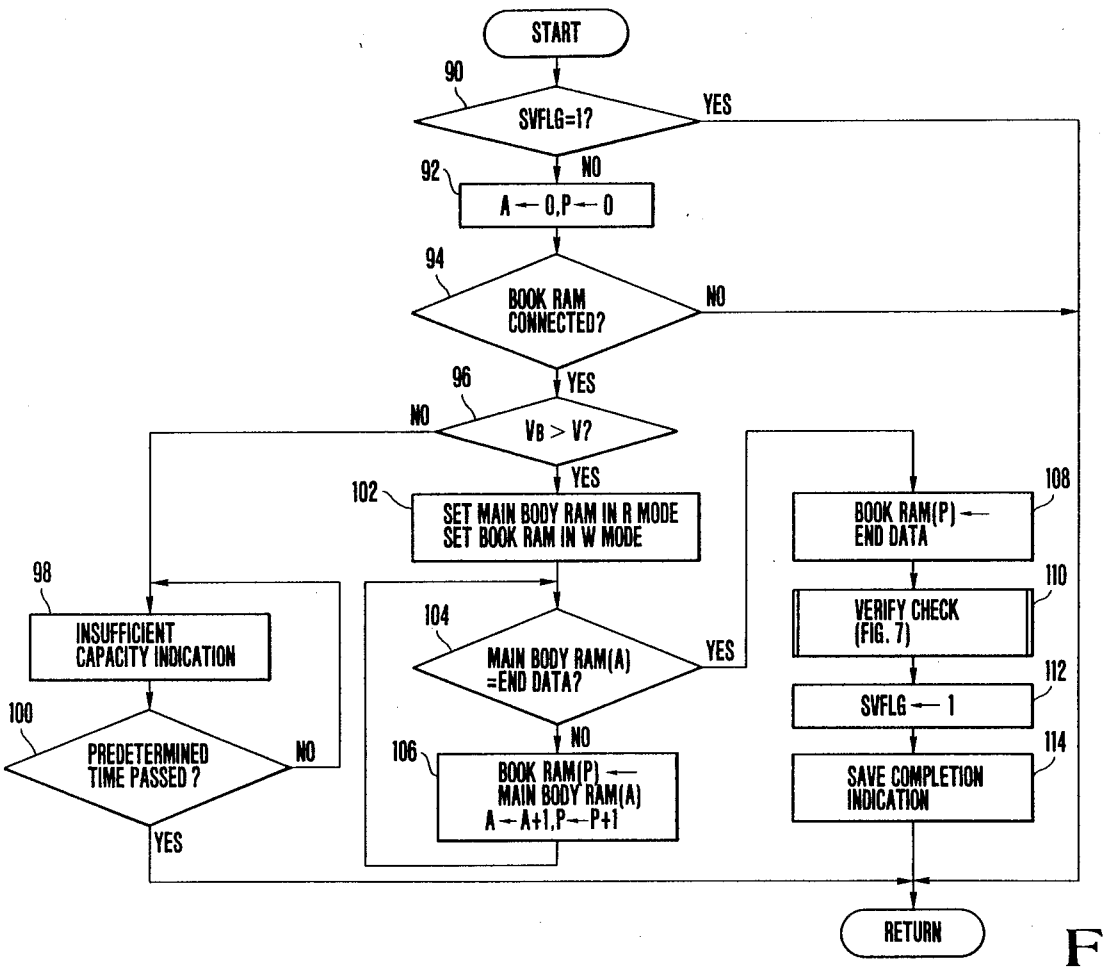
FIG. 5 is a flow chart of a subroutine of book save processing.

Subroutine of Book Save Processing (FIG. 5)

In the subroutine of book save processing shown in FIG. 5, the CPU 18 checks in step 90 whether the flag SVFLG is 1 (i.e., data is completely saved in the pack RAM). If Y in step 90, the flow returns to the routine of FIG. 3. Therefore, in this case, no data transfer is executed from the main body RAM to the RAM book 26.

If N in step 90 (i.e., no data is saved in the pack RAM), the flow advances to step 92, and initialization for the book save processing is executed. For example, 0s are set in both the pointers A and P. Then, the flow advances to step 94.

In step 94, the CPU 18 checks whether a book RAM (a RAM of the RAM book 26) is already connected to the musical instrument main body. If N in step 94, the flow returns to the routine of FIG. 3. If Y in step 94, the flow advances to step 96.

In step 96, the CPU 18 checks whether a memory capacity $V_B$ of the book RAM is larger than the using amount (information amount) V of the main body RAM 22 (i.e., whether data can be stored in the book RAM). If N in step 96, the flow advances to step 98.

In step 98, the indicator 16A indicates an insufficient capacity as in step 68 described above. Then, the flow advances to step 100, and the CPU 18 checks whether a predetermined time has passed from start of flickering of the indicator 16A. As long as N in step 100, the flow returns to step 98, and the indicator 16A continuously indicates th insufficient capacity.

If Y in step 100, the flow returns to the routine of FIG. 3. Note that instead of step 100, processing similar to that indicated by the broken line in FIG. 4 may be executed.

If Y in step 96, the flow advances to step 102, and the main body RAM 22 is set in the read mode (R mode) and at the same time the book RAM is set in the write mode (W mode). Then, the flow advances to step 104.

In step 104, the CPU 18 checks whether data at the address A of the main body RAM 22 is end data. If N in step 104, the flow advances to step 106.

In step 106, the data at the address A of the main body RAM 22 is transferred to and stored at the address P of the book RAM. Then, values of the pointers A and P are incremented by one. Thereafter, the flow returns to step 104, and steps 104 and 106 are repeated until the pointer A points the end data.

When the pointer A points the end data, Y is obtained in step 104, and the flow advances to step 108. In step 108, the end data is transferred to and stored at the address P of the book RAM. Then, the flow advances to step 110.

In step 110, a subroutine of verify check is executed as will be described later with reference to FIG. 7. Thereafter, the flow advances to step 112.

In step 112, 1 is set in the flag SVFLG. Then, the flow advances to step 114, and the indicator 16A is turned off in accordance with SVFLG=1, thereby indicating completion of save. Thereafter, the flow returns to the routine of FIG. 3.

Figure 6:
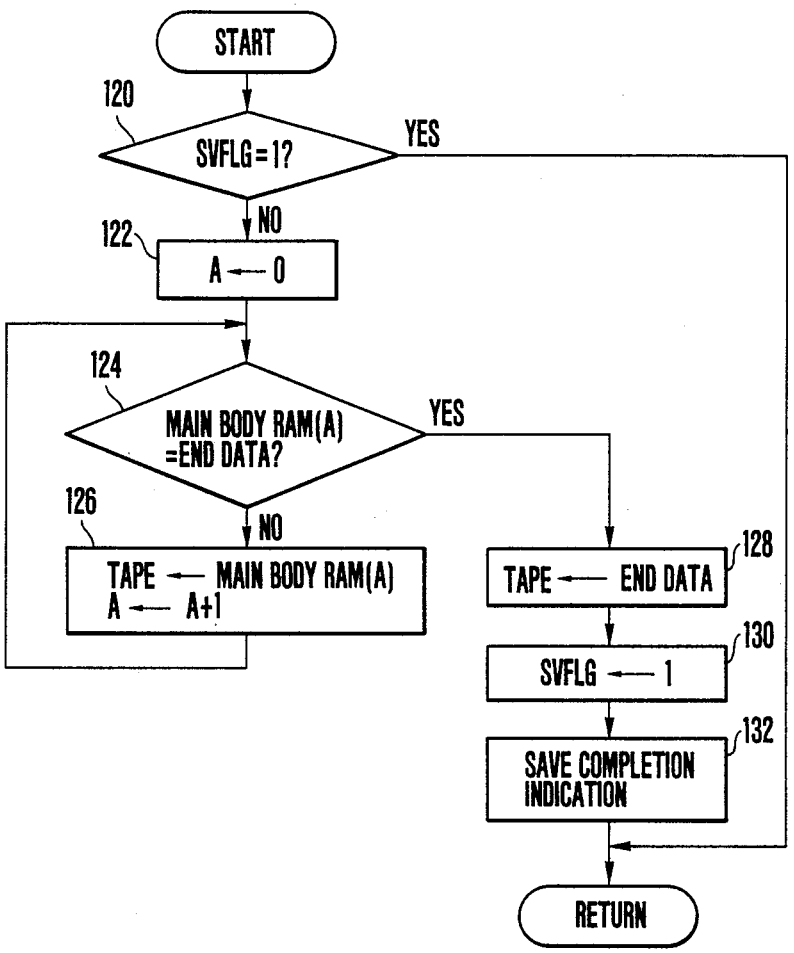
FIG. 6 is a flow chart of a subroutine of tape save processing.

Subroutine of Tape Save Processing (FIG. 6)

In the subroutine of tape save processing shown in FIG. 6, the CPU 18 checks in step 120 whether the flag SVFLG is 1 (i.e., whether data is completely saved in the pack RAM or the book RAM). If Y in step 120, the flow returns to the routine of FIG. 3. Therefore, in this case, no data transfer is executed from the main body RAM 22 to the magnetic tape recording device 28.

If N in step 120 (i.e., no data is saved in the pack RAM or the book RAM), the flow advances to step 122, and initialization for the tape save processing is executed. For example, 0 is set in the pointer A. Then, the flow advances to step 124.

In step 124, the CPU 18 checks whether data at the address A of the main body RAM 22 is end data. If N in step 124, the flow advances to step 126.

In step 126, the data at the address A of the main body RAM 22 is transferred to the magnetic tape recording device 28 and stored in a magnetic tape. Then, a value of the pointer A is incremented by one. Thereafter, the flow returns to step 124, and steps 124 and 126 are repeated until the pointer A points the end data.

When the pointer A points the end data, Y is obtained in step 124, and the flow advances to step 128. In step 128, the end data is transferred to the magnetic tape recording device 28 and stored in the magnetic tape. Then, the flow advances to step 130.

In step 130, 1 is set in the flag SVFLG. Then, the flow advances to step 132, and the indicator 16A is turned off in accordance with SVFLG=1, thereby indicating completion of save. Thereafter, the flow returns to the routine of FIG. 3.

Figure 7:
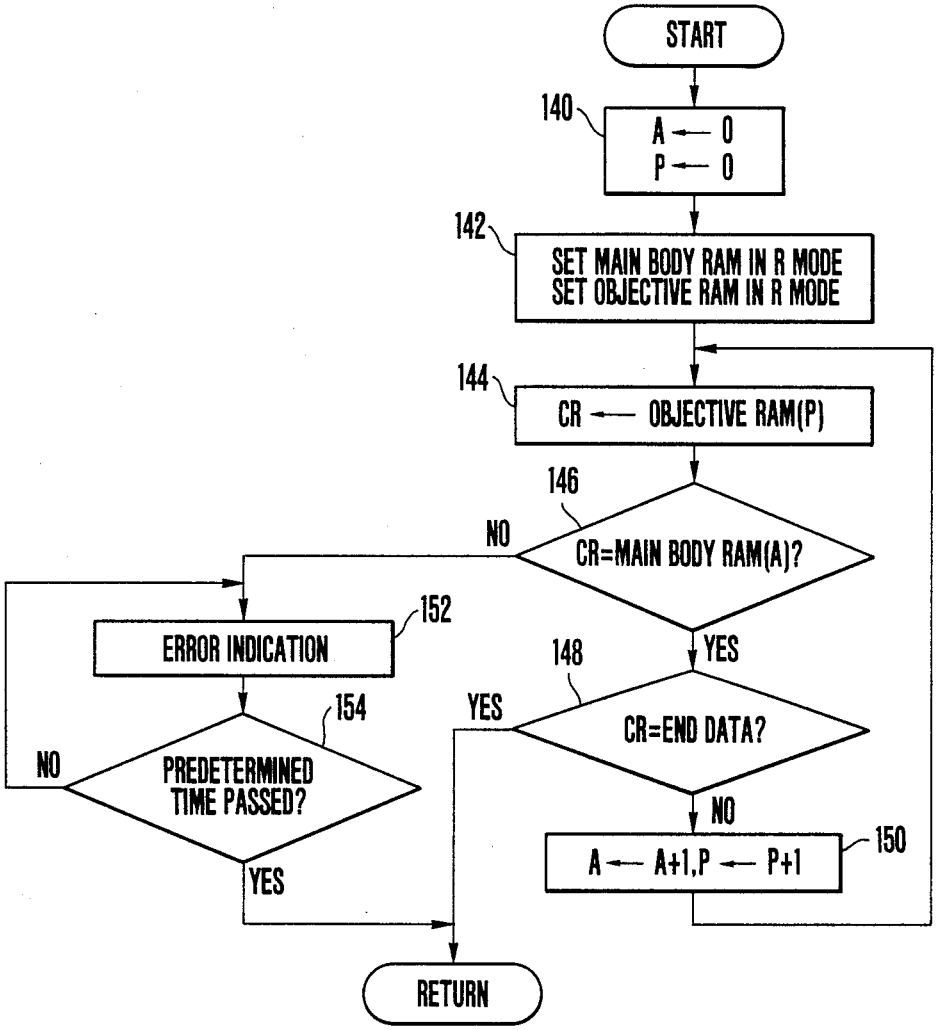
FIG. 7 is a flow chart of a subroutine of a verify check.

Subroutine of Verify Check (FIG. 7)

In the subroutine of verify check shown in FIG. 7, initialization for verify check is executed in step 140. For example, 0s are set in both the pointers A and P. Then, the flow advances to step 142.

In step 142, the main body RAM 22 is set in the read mode (R mode) and at the same time the objective RAM is set in the R mode. The objective RAM is the pack RAM in the routine of FIG. 4 and is the book RAM in the routine of FIG. 5.

Then, in step 144, data at the address P of the objective RAM is set in a comparing register CR. The register CR is included in the working memory 21. After step 144, the flow advances to step 146.

In step 146, the CPU 18 checks whether the data in the register CR coincides with the data at the address A of the main memory 22. If Y in step 146, the flow advances to step 148, and the CPU 18 checks whether the data in the register CR is end data. If N in step 148, values of the pointers A and P are incremented by one in step 150. Then, the flow returns to step 144, and steps 144 to 150 are repeatedly executed as described above. As a result, it can be checked whether the same data as in the main body RAM 22 are properly stored in the objective RAM.

If N in step 146, the flow advances to step 152, and the indicator 16A is flickered to indicate occurrence of a save error. In this case, the indicator 16A can be flickered in the same manner as that executed when an insufficient capacity is t be indicated. However, in order to discriminate error indication from insufficient capacity indication, a flickering rate of the error indication differs from that of the insufficient capacity indication.

In step 154 after step 152, the CPU 18 checks whether a predetermined time has passed from start of flickering of the indicator 16A. In this case, the predetermined time is determined in consideration of, e.g., a time required for executing save again.

As long as N in step 154, the flow returns to step 152, and the error indication is continued. Therefore, if the save switch 14A is turned on during this error indication, save can be executed again.

If Y in step 154 or 148, the flow returns to the original routine (routine of FIG. 4 or 5).

Figure 8:
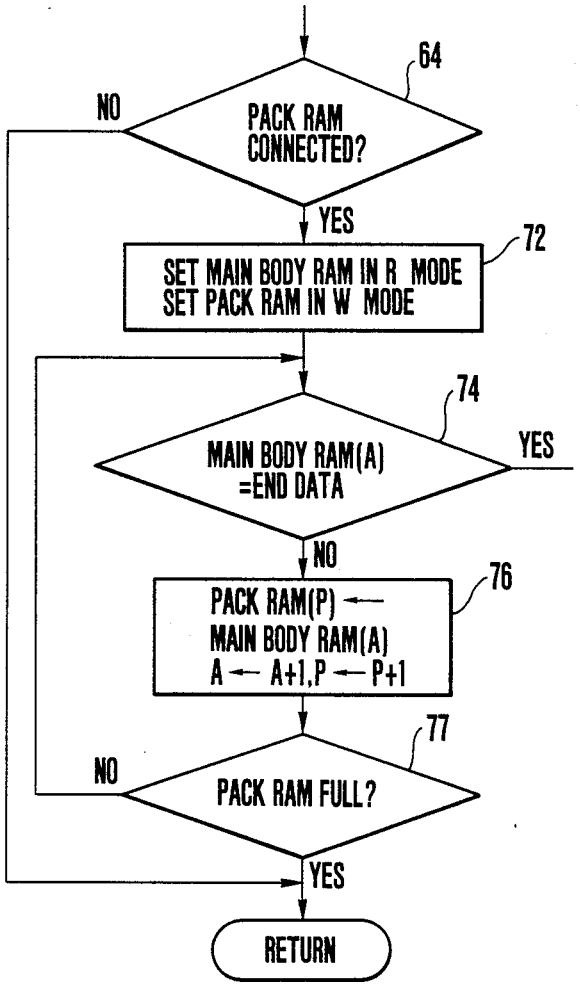
FIG. 8 is a flow chart of a modification of the routine of FIG. 4.

Modification of Routine in FIG. 4 (FIG. 8)

FIG. 8 shows a modification of the routine in FIG. 4. In FIG. 8, processing to step 64 and processing executed when Y is set in step 74 are similar to those described above with reference to FIG. 4, and a detailed description thereof will be omitted.

If N in step 64 (i.e., the pack RAM is not connected), the flow returns to the routine of FIG. 3. If Y in step 64, the flow advances to step 72, and the main body RAM 22 is set in the R mode and at the same time the pack RAM is set in the W mode. Then, the flow advances to step 74.

In step 74, the CPU 18 checks whether data at the address A of the main body RAM 22 is end data. If N in step 74, the flow advances to step 76.

In step 76, the data at the address A of the main body RAM 22 is transferred to and stored at the address P of the pack RAM. Values of the pointers A and P are incremented by one. Thereafter, the flow advances to step 77.

In step 77, the CPU 18 checks whether the pack RAM is full. If N in step 77, the flow returns to step 74, and steps 74 to 77 are repeatedly executed in the same manner as described above.

If Y is obtained in step 74 before Y is obtained in step 77, the flow returns to the routine of FIG. 3 through steps 78 to 84 of FIG. 4. In this case, the data of the main body RAM are completely stored in the pack RAM.

If Y is obtained in step 77 before Y is set in step 74, the flow returns to the routine of FIG. 3. In this case, the data in the main body RAM 22 cannot be completely stored in the pack RAM.

When the routine of FIG. 4 is modified as shown in FIG. 8, the routine of FIG. 8 can be used in the routine of FIG. 5.

Figure 9:
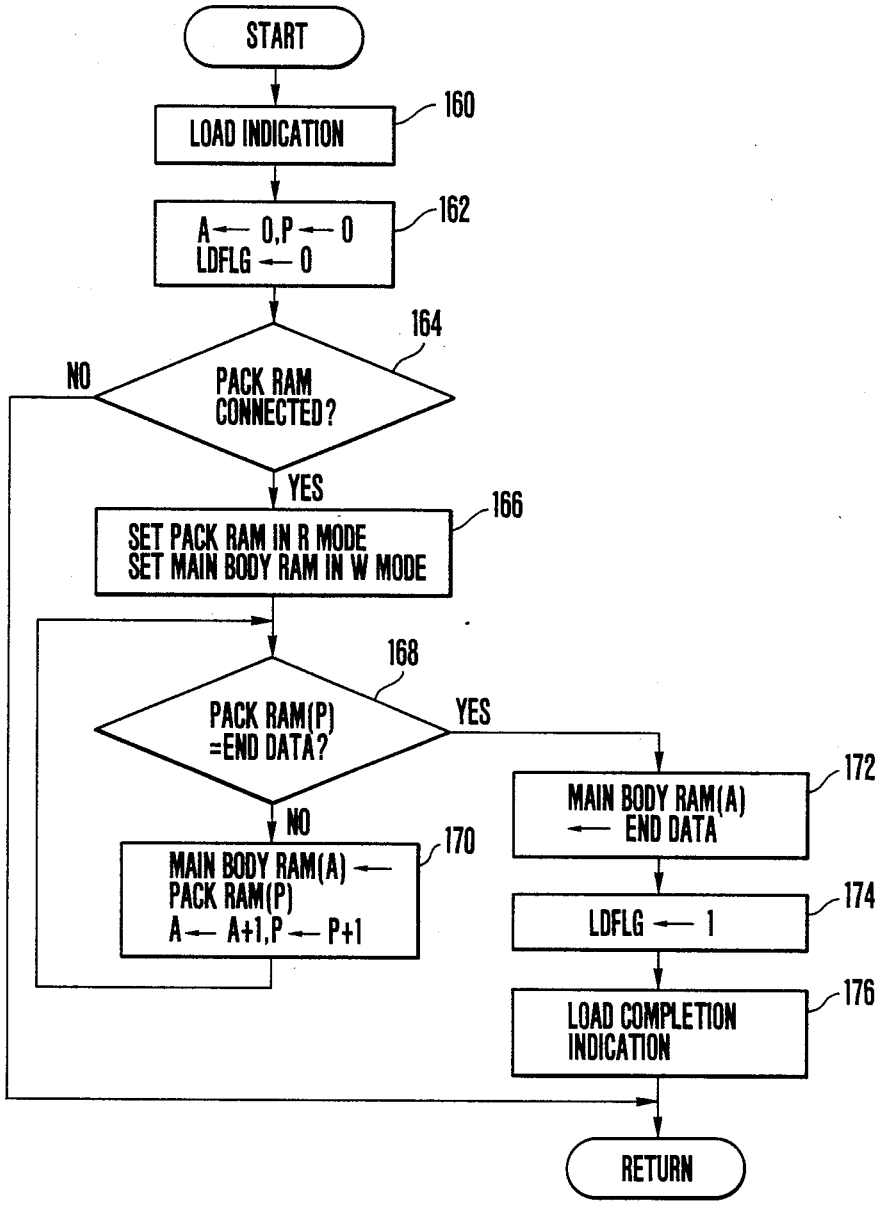
FIG. 9 is a flow chart of a subroutine of pack load processing.

Subroutine of Pack Load Processing (FIG. 9)

In the subroutine of pack load processing shown in FIG. 9, the load indicator 16B is turned on to indicate the load mode in step 160. Then, the flow advances to step 162.

In step 162, initialization processing of various registers is executed. For example, 0s are set in the pointers A and P and the load flag LDFLG. The flag LDFLG is included in the working memory 21.

Then, in step 164, the CPU 18 checks whether the pack RAM is already connected to the musical instrument main body. If N in step 164, the flow returns to the routine of FIG. 3. If Y in step 164, the flow advances to step 166.

In step 166, the pack RAM is set in the R mode and at the sam time the main body RAM is set in the W mode. Then, the flow advances to step 168.

In step 168, the CPU 18 checks whether data at the address P of the pack RAM is end data. If N in step 168, the flow advances to step 170.

In step 170, the data at the address P of the pack RAM is transferred to and stored at the address A of the main body RAM. Then, values of the pointers A and P are incremented by one. Thereafter, the flow returns to step 168, and steps 168 and 170 are repeatedly executed until the pointer P points the end data.

When the pointer P points the end data, Y is obtained in step 168, and the flow advances to step 172. In step 172, the end data is transferred to and stored at the address A of the main body RAM 22.

Thereafter, 1 is set in the flag LDFLG in step 174, and then the flow advances to step 176. In step 176, the indicator 16B is turned off in accordance with LDFLG=1, thereby indicating completion of load. Then, the flow returns to the routine of FIG. 3.

Figure 10:
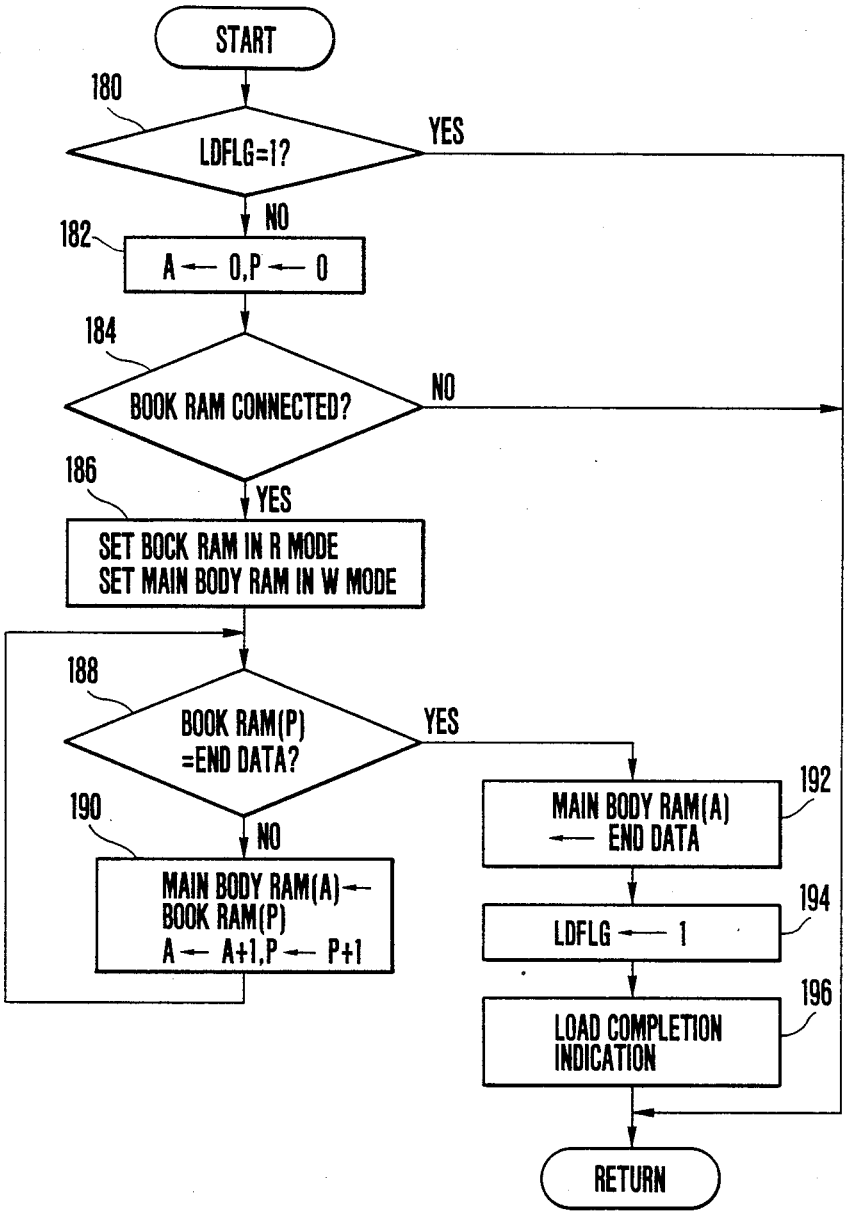
FIG. 10 is a flow chart of a subroutine of book load processing.

Subroutine of Book Load Processing (FIG. 10)

In the subroutine of book load processing shown in FIG. 10, the CPU 18 checks in step 180 whether the flag LDFLG is 1 (i.e., whether data is completely loaded from the pack RAM). If Y in step 180, the flow returns to the routine of FIG. 3. Therefore, in this case, no data transfer is executed from the RAM book 26 to the main body RAM 22.

If N in step 180 (i.e., no data is loaded from the pack RAM), the flow advances to step 182, and initialization for the book load processing is executed. For example, 0s are set in both the pointers A and P. Then, the flow advances to step 184.

In step 184, the CPU 18 determines whether the book RAM is already connected to the musical instrument main body. If N in step 184, the flow returns to the routine of FIG. 3. If Y in step 184, the flow advances to step 186.

In step 186, the book RAM is set in the R mode and at the same time the main body RAM 22 is set in the W mode. Then, the flow advances to step 188.

In step 188, the CPU 18 determines whether data at the address P of the book RAM is end data. If N in step 188, the flow advances to step 190.

In step 190, the data at the address P of the book RAM is transferred to and stored at the address A of the main body RAM. Then, values of the pointers A and P are incremented by one. Thereafter, the flow returns to step 188, and steps 188 and 190 are repeatedly executed until the pointer P points the end data.

When the pointer P points the end data, Y is obtained in step 188, and the flow advances to step 192. In step 192, the end data is transferred to and stored at the address A of the main body RAM 22.

Thereafter, 1 is set in the flag LDFLG in step 194. Then, the flow advances to step 196, and the indicator 16B is turned off in accordance with LDFLG=1, thereby indicating completion of load. Then, the flow returns to the routine of FIG. 3.

Figure 11:
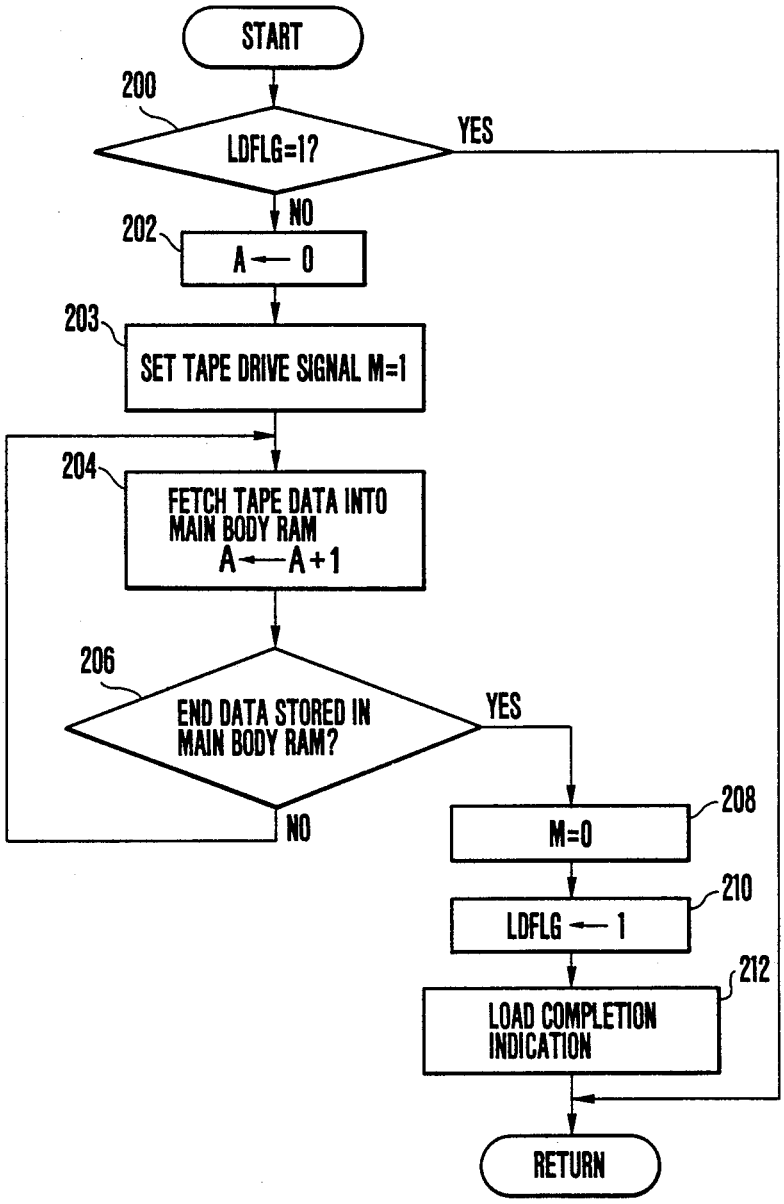
FIG. 11 is a flow chart of a subroutine of tape load processing.

Subroutine of Tape Load Processing (FIG. 11)

In the subroutine of tape load processing shown in FIG. 11, the CPU 18 checks in step 200 whether the flag LDFLG is 1 (i.e., whether data is completely loaded from the pack RAM or the book RAM). If Y is set in step 200, the flow returns to the routine of FIG. 3. Therefore, in this case, no data transfer is executed from the magnetic tape recording device 28 to the main body RAM 22.

If N in step 200 (i.e., no data is loaded from the pack RAM or the book RAM), the flow advances to step 202, and initialization for the tape load processing is executed. For example, 0 is set in the pointer A. Then, the flow advances to step 203.

In step 203, 1 is set as a tape drive signal M. As a result, the magnetic tape recording device 28 starts a reproduction operation.

Then, in step 204, tape data is fetched in the main body RAM 22. Thereafter, a value of the pointer A is incremented by one, and then the flow advances to step 206. In step 206, the CPU 18 checks whether the end data is stored at the address A of the main body RAM 22. If N in step 206, the flow returns to step 204, and steps 204 and 206 are repeatedly executed until the end data is written.

When the end data is written in the main body RAM 22, Y is set in step 206, and the flow advances to step 208. In step 208, 0 is set as the tape drive signal M. As a result, the reproduction operation of the magnetic tape recording device 28 is stopped.

Thereafter, in step 210, 1 is set in the flag LDFLG. Then, the flow advances to step 212, and the indicator 16B is turned off in accordance with LDFLG=1, thereby indicating completion of load. Thereafter, the flow returns to the routine of FIG. 3.

Note that when the magnetic tape recording device 28 is not connected to the musical instrument main body, Y is not obtained in step 206, so that no load completion is indicated.

Figure 12:
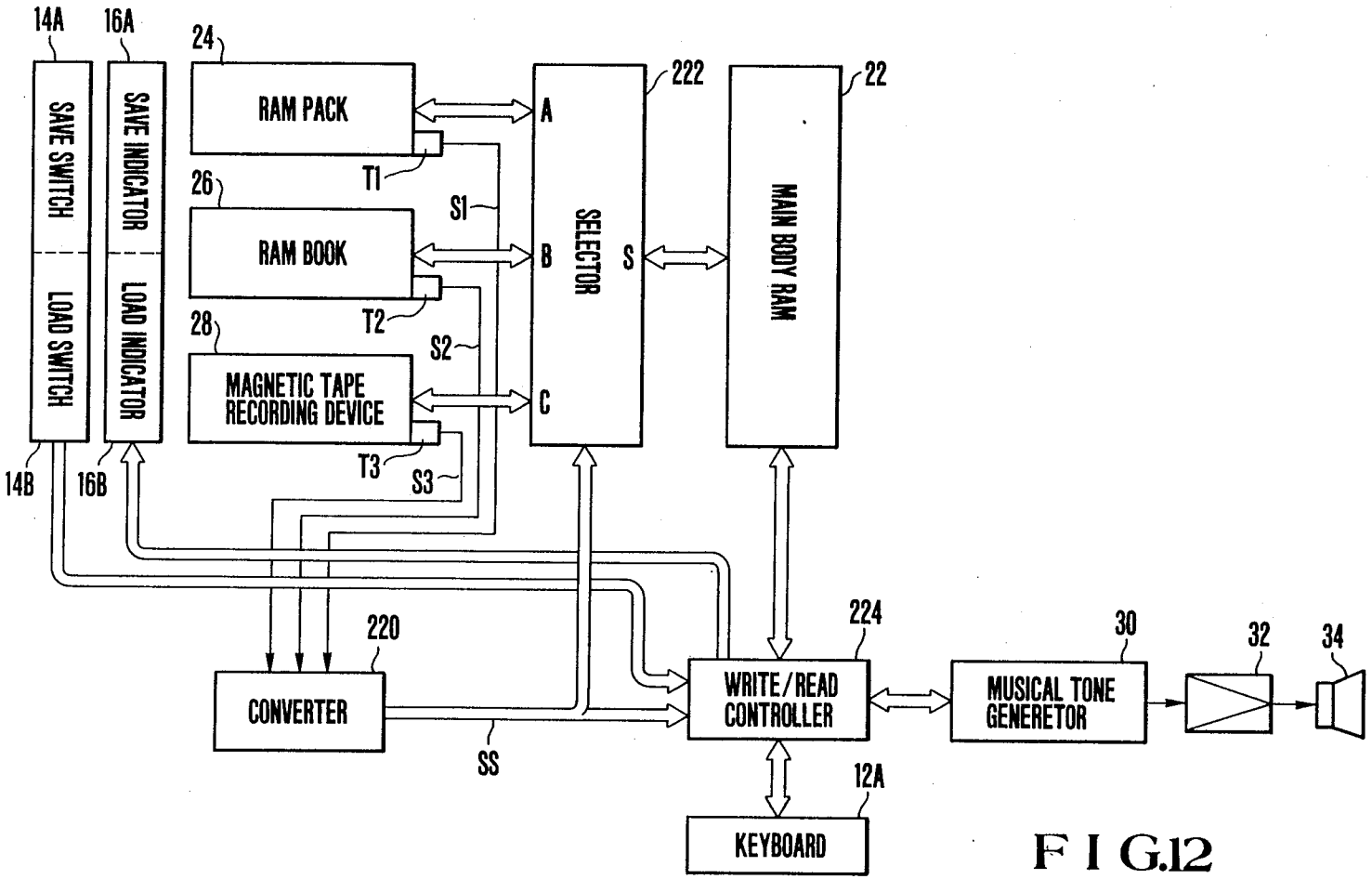
FIG. 12 is a block diagram of a circuit arrangement of an electronic musical instrument according to another embodiment of the present invention.

Another Embodiment (FIG. 12)

FIG. 12 shows a circuit arrangement of an electronic musical instrument according to another embodiment of the present invention. In FIG. 12, the same parts as in FIG. 1 are denoted by the same reference numerals and a detailed description thereof will be omitted.

The embodiment of FIG. 12 is characterized in that connection detectors T1, T2, and T3 are provided in correspondence to the RAM pack 24, the RAM book 26, and the magnetic tape recording device 28, respectively, and a converter 220 is provided to convert outputs S1 to S3 from the connection detectors into a selection signal SS, thereby controlling an operation of a selector 222 and a write/read controller 224 in accordance with the selection signal SS from the converter 220.

When the RA pack 24 is connected to the musical instrument main body, the output S1 from the detector T1 is switched to 1. When the RAM book 26 is connected to the musical instrument main body, the output S2 from the detector T2 is switched to 1. When the magnetic tape recording device 28 is connected to the musical instrument main body, the output S3 from the detector T3 is switched to 1. The output from each detector is 0 when a corresponding external memory (or recording) device is not connected.

The RAM pack 24 is connected to a terminal portion A of the selector 222, the RAM book 26 is connected to a terminal portion B thereof, and the magnetic tape recording device 28 is connected to a terminal portion C thereof, respectively. In addition, the main body RAM 22 is connected to a terminal portion S of the selector 222.

If the detector output S1 is 1, the converter 220 outputs the selection signal SS for coupling the terminal portion A to the terminal portion S in the selector 222 regardless of states of the other detector outputs S2 and S3. At this time, the selection signal SS is also supplied to the write/read controller 224. The controller 224 controls musical tone information transfer from the main body RAM 22 to the RAM pack 24 or vice versa and at the same time controls indication of the save or load indicator 16A or 16B in accordance with an operation of the save or load switch 14A or 14B.

If the detector output S1 is 0 and the detector output S2 is 1, the converter 220 outputs the selection signal SS for coupling the terminal portion B to the terminal portion S in the selector 222 regardless of the state of the detector output S3. At this time, the write/read controller 224 controls musical tone information transfer between the RAM book 26 and the main body RAM 22 and at the same time controls indication of the indicator 16A or 16B in accordance with the selection signal SS and a command supplied from the switch 14A or 14B.

If the detector outputs S1 and S2 are 0s, the converter 220 outputs the signal SS for coupling the terminal portion C to the terminal portion S in the selector 222 regardless of the state of the detector output S3. At this time, the write/read controller 224 controls musical tone information transfer between the magnetic tape recording device 28 and the main body RA 22 and at the same time controls indication of the indicator 16A or 16B in accordance with the selection signal SS and a command from the switch 14A or 14B.

In addition to the above information transfer control, the write/read controller 224 controls transfer of musical tone parameter control information and/or automatic performance information from the main body RAM 22 to the musical tone generator 30, controls transfer of the musical tone parameter control information from the musical instrument panel to the main body RAM 22, and controls transfer of performance information from the keyboard 12A to the main body RAM 22.

Note that in the above embodiments, the RAM pack, the RAM book, and the magnetic tape recording device are exemplified as the external memory (or recording) devices. However, the present invention can be applied to not only a case wherein a plurality of external memory (or recording) devices of different types are used but also a case wherein a plurality of external memory (or recording) devices of the same type are used (e.g., a plurality of RAM packs are used).

As has been described above, according to the present invention, since the number of switches and indicators to be arranged on a musical instrument panel surface can be reduced, an installation space can be reduced, and a peripheral circuit can be simplified. In addition, a switching operation can be easily executed.

What is claimed is:

1. An electronic musical instrument comprising:

a musical tone information storing device for storing musical tone information;

a plurality of external memory devices;

control means for controlling information transfer between at least one of said external memory devices and said musical tone information storing device;

switching means for generating a transfer command; and determining means for determining an external memory device of a highest priority in accordance with a predetermined priority which is in a transfer enable state, wherein said control means controls information transfer between the external memory device of the highest priority which is determined by said determining means and said musical tone information storing device.

2. A musical instrument according to claim 1, further comprising capacity checking means for checking whether a memory capacity of an external memory device to which information is to be transferred is larger than all information amount of said musical tone information storing device, wherein said control means controls transfer when the memory capacity of said external memory device to which information is to be transferred is larger than the information amount of said musical tone information storing device.

3. A musical instrument according to claim 1, wherein when said determining means determines on the basis of the transfer command generated from said switching means that said external memory device of the highest priority is not in the transfer enable state, said control means causes said determining means to determine whether an external memory device of the next priority is in a transfer enable state.

4. A musical instrument according to claim 3, wherein said control means controls information transfer between said external memory device of the next priority and said musical tone information storing device in accordance with information obtained from said determining means.

5. A musical instrument according to claim 1, further comprising full checking means for, when information is transferred to an external memory device, checking whether said external memory device is filled, wherein when said external memory device is filled during transfer, said control means causes said determining means to determine whether an external memory device of the next priority is in the transfer enable state, and when said external memory device of the next priority is in the transfer enable state, transfers the information to said external memory device of the next priority.

6. A musical instrument according to claim 1, further comprising connection information means for representing which external memory devices is connected to a musical instrument main body, wherein said determining means determines on the basis of connection information from said connection information means whether said external memory device of the highest priority is in the transfer enable state.

7. A musical instrument according to claim 1, wherein the musical tone information is input by a key operation.

8. A musical instrument according to claim 1, wherein the musical tone information is pitch and tone duration information.

* * * * *